US009387972B1

(12) United States Patent
Wang

(10) Patent No.: US 9,387,972 B1
(45) Date of Patent: Jul. 12, 2016

(54) ANTI-THEFT STRUCTURE OF HAND TOOL DISPLAY TAG

(71) Applicant: TOP RANK INDUSTRIAL CO., LTD., Taichung (TW)

(72) Inventor: Ting-Hsien Wang, Taichung (TW)

(73) Assignee: TOP RANK INDUSTRIAL CO., LTD., Tainan (TW)

( * ) Notice: Subject to any disclaimer, the term of this patent is extended or adjusted under 35 U.S.C. 154(b) by 0 days.

(21) Appl. No.: 14/828,481

(22) Filed: Aug. 17, 2015

(51) Int. Cl.
*B65D 73/00* (2006.01)
*B65D 79/02* (2006.01)

(52) U.S. Cl.
CPC ..... *B65D 79/02* (2013.01); *B65D 73/0064* (2013.01); *B65D 2211/00* (2013.01); *Y10S 206/806* (2013.01)

(58) Field of Classification Search
CPC ..... B65D 73/0064; B65D 2211/00; Y10S 206/806; A45F 2200/0575
USPC ..... 206/349, 461, 372, 376, 377, 379, 481, 206/806, 807; 211/69, 70.6
See application file for complete search history.

(56) References Cited

U.S. PATENT DOCUMENTS 5,484,056 A * 1/1996 Wood ..... B65D 73/0064 206/349
6,241,092 B1 * 6/2001 Vasudeva ..... B65D 25/103 206/349
6,425,482 B1 * 7/2002 Chiang ..... G03F 7/0758 206/349
6,637,591 B2 * 10/2003 Chen ..... B65D 73/0014 206/349
7,175,151 B2 * 2/2007 Chang ..... B65D 73/0014 206/349
8,336,710 B2 * 12/2012 Chang ..... B25H 3/04 206/349
2004/0124106 A1 * 7/2004 Chen ..... B25H 3/006 206/376
2005/0155945 A1 * 7/2005 Kao ..... B29C 33/005 211/70.6
2007/0228240 A1 * 10/2007 Kao ..... A47F 5/0006 206/349

* cited by examiner

*Primary Examiner* — Luan K Bui
(74) *Attorney, Agent, or Firm* — Raymond Y. Chan; David and Raymond Patent Firm

(57) ABSTRACT

An anti-theft structure of a hand tool display tag includes a positioning protrusion seat extending from an extension portion of a display tag. A front end face of the positioning protrusion seat is provided with a positioning trough penetrating the inside of the positioning protrusion seat. A rear end of the positioning protrusion seat is provided with a side through hole with a side positioning piece. A C-shaped buckle embedded to a rod body of a hand tool is confined and hidden between the positioning trough and the side positioning piece, such that the hand tool is unable to disengage from the display tag so as to provide an anti-theft function. Scissors can be used to cut off the side positioning piece. A tool is inserted to push the C-shaped buckle out of the positioning trough, such that the hand tool can disengage from the display tag.

6 Claims, 16 Drawing Sheets

ANTI-THEFT STRUCTURE OF HAND TOOL DISPLAY TAG

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

1. Field of Invention

The present invention relates to an anti-theft structure of a hand tool display tag, and more particularly, to a hand tool having a rod body buckled by a C-shaped buckle so that the hand tool is unable to disengage from a display tag, providing display and anti-theft functions.

2. Description of Related Arts

In general, there are many hand tools (for example, screwdrivers and so on) displayed for sale in supermarkets and hypermarkets. In order to facilitate the presentation and classification, a display tag is used to couple a rod body of a hand tool for displaying the hand tool. As shown in FIG. 1, a conventional hand tool display tag 10 comprises a main body 11 and an annular positioning trough 12 at the lower end of the main body 11. Two inner sides of the annular positioning trough 12 are formed with grooves 13, respectively. A rod body 2 of a hand tool 1 can be inserted into the annular positioning trough 12 from the bottom of the display tag 10. By the grooves 13, the annular positioning trough 12 can be elastically deformed to clamp the rod body 2 of the hand tool 1, preventing the hand tool 1 from falling. The conventional display tag 10 doesn't provide an anti-theft function. These days, there are many theft matters. The thief often takes advantage of people walking commotion or unattended situations to pull the hand tool away from the display tag 10 and hid the hand tool in the thief s body or carry-bag. For the stores, this causes great loss. Accordingly, the inventor of the present invention has devoted himself based on his many years of practical experiences to solve this problem.

SUMMARY OF THE PRESENT INVENTION

The primary object of the present invention is to provide an anti-theft structure of a hand tool display tag to solve the aforesaid problems.

In order to achieve the aforesaid object, the present invention comprises a positioning protrusion seat extending from an extension portion of a display tag. A front end face of the positioning protrusion seat is formed with a horizontal positioning trough penetrating the inside of the positioning protrusion seat. A rear end of the positioning protrusion seat is formed with a side through hole. The side through hole is transversely provided with a side positioning piece corresponding to the positioning trough. The C-shaped buckle embedded to the rod body of the hand tool is confined and hidden between the positioning trough and the side positioning piece, such that the hand tool is unable to disengage from the display tag so as to provide an anti-theft function. When the user wants to disengage the hand tool from the display tag, a pair of scissors is used to cut off the side positioning piece. A tool is inserted into the side through hole to push the C-shaped buckle out of the positioning trough, such that the hand tool can disengage from the display tag.

Another object of the present invention is to provide a positioning protrusion seat extending from an extension portion of a display tag. The positioning protrusion seat comprises a positioning seat and a separate positioning cover. The positioning seat is formed with a rear positioning trough. The positioning cover is formed with a front positioning trough. Two sides of the positioning cover are provided with engaging portions, respectively. The engaging portions of the positioning cover are coupled to the extension portion, enabling the C-shaped buckle to be covered and hidden between the front and rear positioning troughs, such that the hand tool is unable to disengage from the display tag so as to provide an anti-theft function. When the user wants to disengage the hand tool from the display tag, a pair of scissors is used to cut off the engaging portions of the positioning cover, such that the C-shaped buckle and the hand tool can disengage from the display tag.

DETAILED DESCRIPTION OF THE PREFERRED EMBODIMENT

Figure 1:
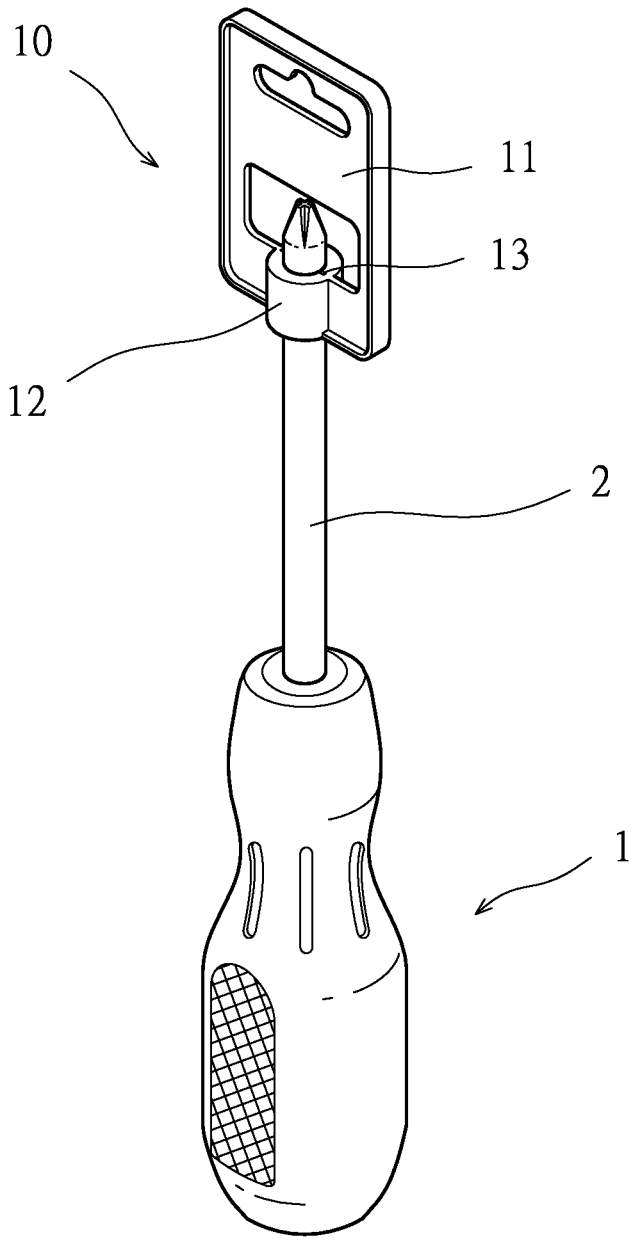
PRIOR ART FIG.1
FIG. 1 is a perspective view of the prior art.
Figure 2:
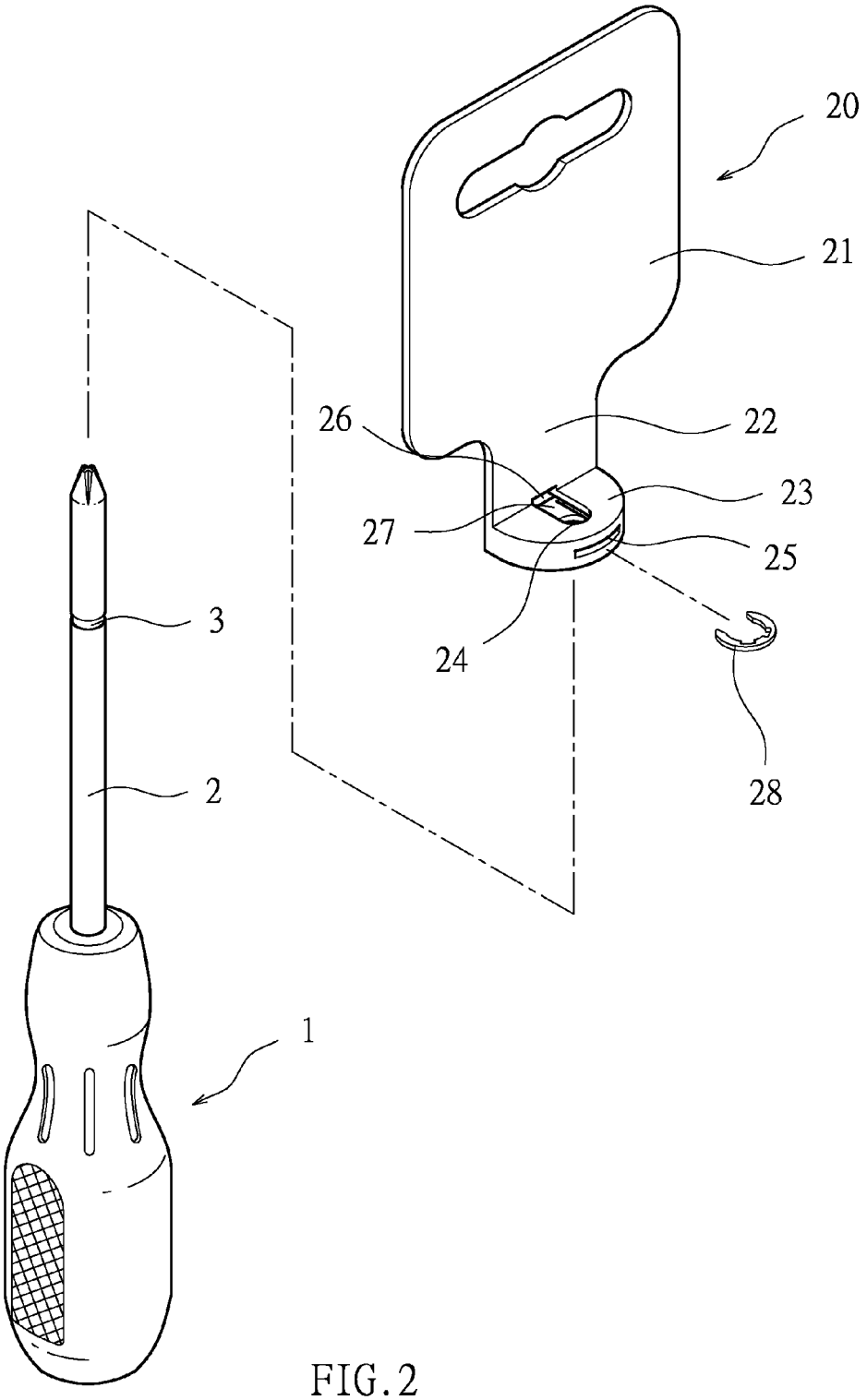
FIG. 2 is an exploded view according to a first embodiment of the present invention.
Figure 3:
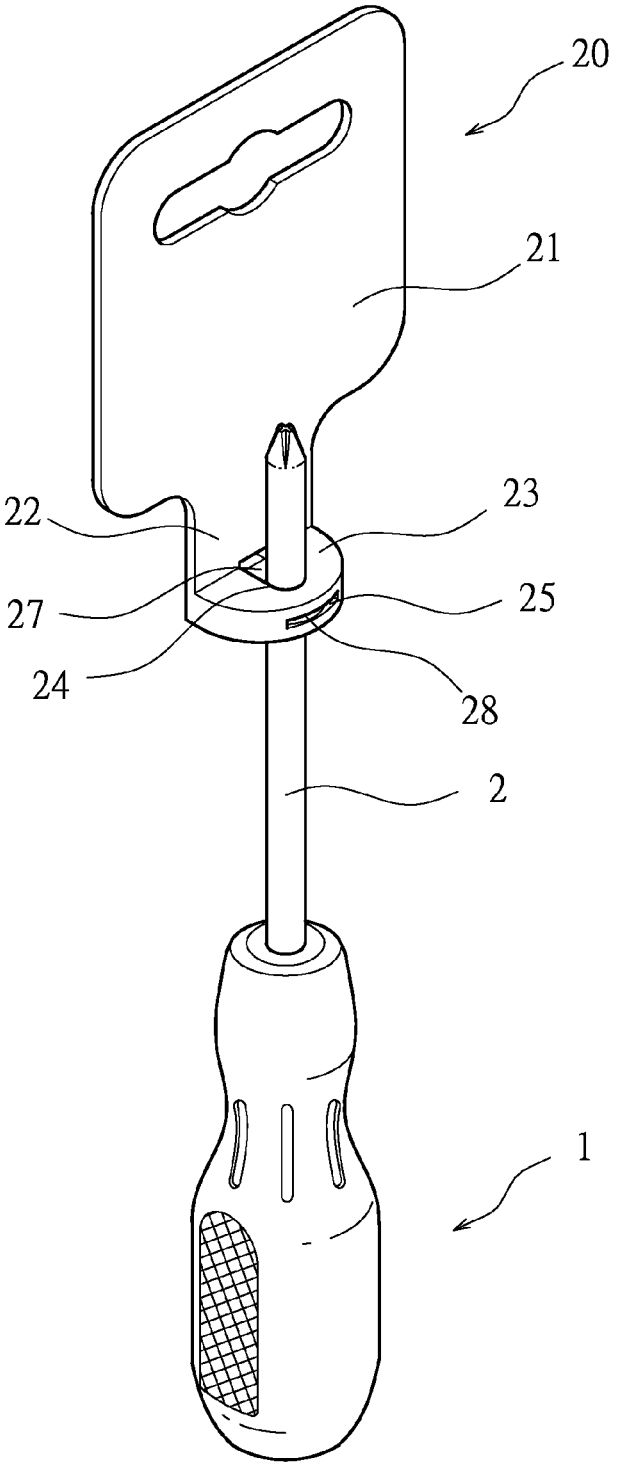
FIG. 3 is a perspective view according to the first embodiment of the present invention.

Embodiments of the present invention will now be described, by way of example only, with reference to the accompanying drawings.

As shown in FIG. 2 through FIG. 7, an anti-theft structure of a hand tool display tag according to a first embodiment of the present invention comprises a hand tool 1 and a display tag 20. The hand tool 1 comprises a rod body 2 having an annular groove 3. The display tag 20 comprises a main body 21 in a rectangular shape and an extension portion 22 disposed at a lower end of the main body 21. The extension portion 22 has a width less than that of the main body 21. A positioning protrusion seat 23 is horizontally provided on the extension portion 22. The positioning protrusion seat 23 has a vertical through hole 24. A front end face of the positioning protrusion seat 23 is formed with a horizontal positioning trough 25 penetrating the inside of the positioning protrusion seat 23. A rear end of the positioning protrusion seat 23 is formed with a side through hole 26 penetrating the inside of the positioning protrusion seat 23 and communicating with the positioning trough 25. The side through hole 26 is transversely provided with a side positioning piece 27. The side positioning piece 27 is located at the same plane as the positioning trough 25. A C-shaped buckle 28 is provided to pass the positioning trough 25 and engage with the annular groove 3 of the rod body 2 of the hand tool 1 passing through the through hole 24, enabling the annular groove 3, the positioning trough 25 and the side positioning piece 27 to be at the same plane and enabling the C-shaped buckle 28 to be positioned between the positioning trough 25 and the side positioning piece 27. Through the aforesaid structure, the rod body 2 of the hand tool 1 is buckled by the C-shaped buckle 28 to be one-piece. The C-shaped buckle 28 is covered and hidden by the positioning protrusion seat 23, such that the hand tool 1 is unable to disengage from the display tag 20 to provide an anti-theft function.

The assembly of the first embodiment of the present invention is described hereinafter. The C-shaped buckle 28 is a thin buckle ring made of a metallic or plastic material, so that it has the capability of elastic deformation to be embedded into the annular groove 3 of the rod body 2 of the hand tool 1 unless an external force is applied to the C-shaped buckle 28 to disengage it from the annular groove 3. When the hand tool 1 is inserted into the through hole 24 of the positioning protrusion seat 23, the C-shaped buckle 28 is embedded and limited in the positioning trough 25. The positioning trough 25 is a slot corresponding in shape and size to the C-shaped buckle 28 for the C-shaped buckle 28 to be covered and hidden by the positioning protrusion seat 23. Thus, it is unable to take out the C-shaped buckle 28 from the exterior of the positioning protrusion seat 23. Even if the display tag 20 is knocked, the C-shaped buckle 28 won't disengage from the annular groove 3 to depart from the positioning trough 25. This provides an anti-theft effect.

Figure 4:
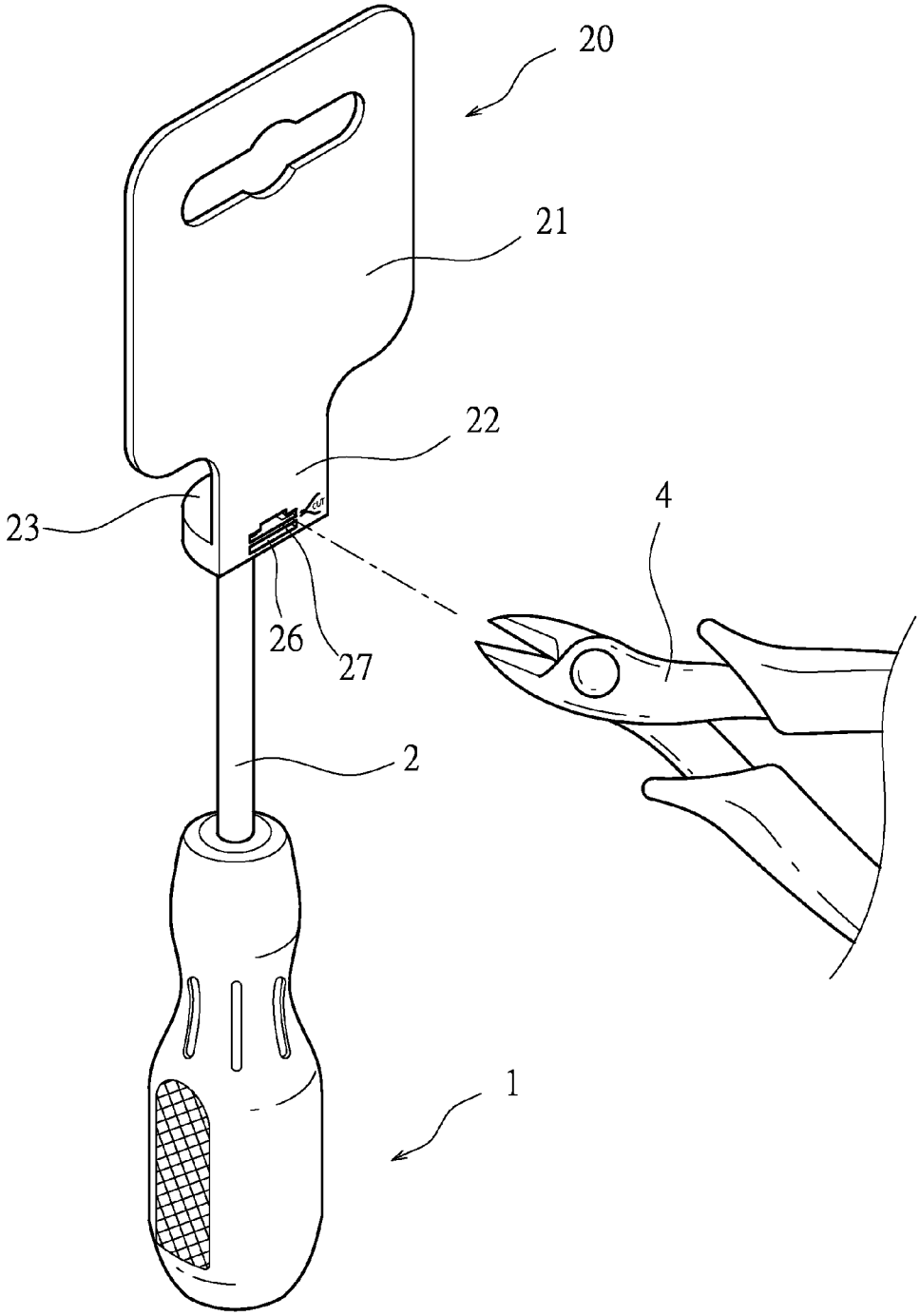
FIG. 4 is a rear perspective view according to the first embodiment of the present invention.
Figure 5:
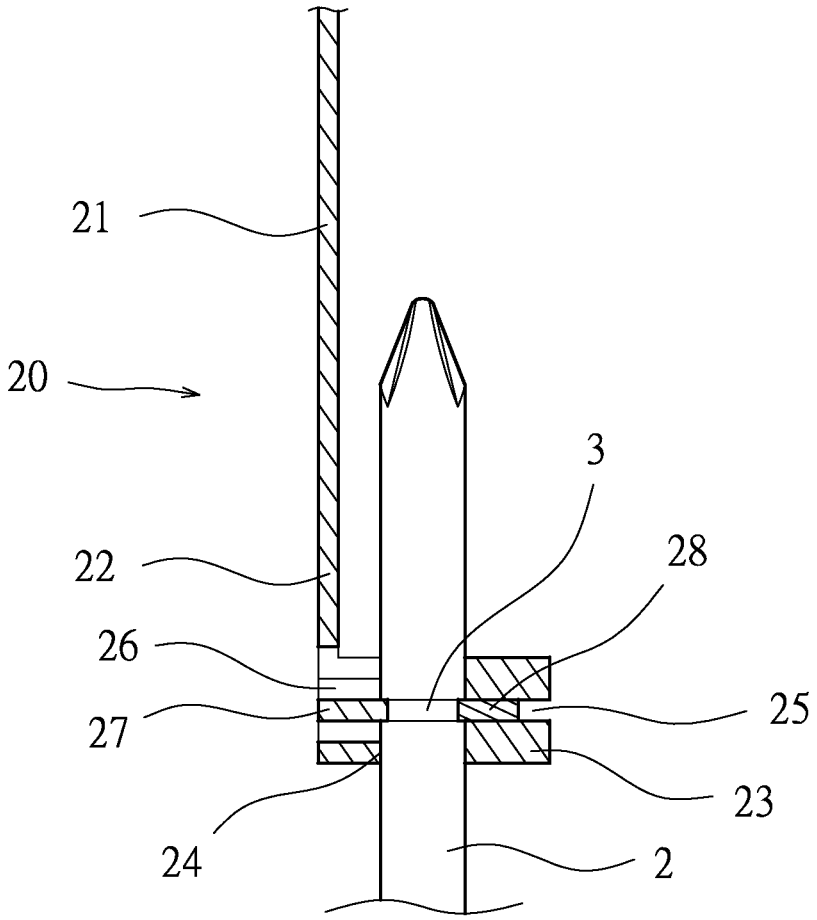
FIG. 5 is a side sectional view according to the first embodiment of the present invention.
Figure 6:
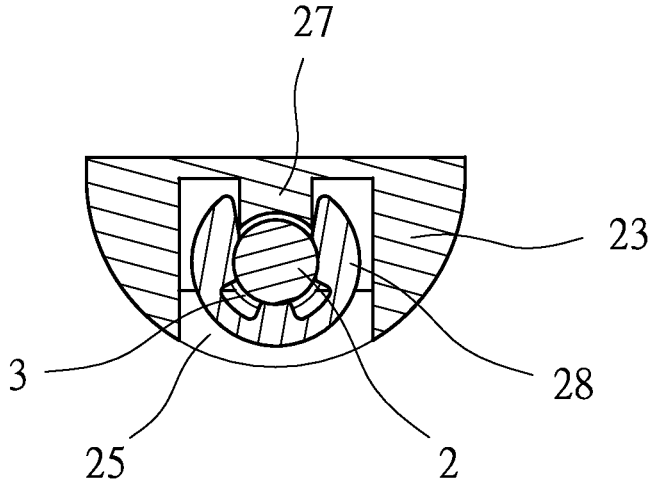
FIG. 6 is a top sectional view according to the first embodiment of the present invention.
Figure 7:
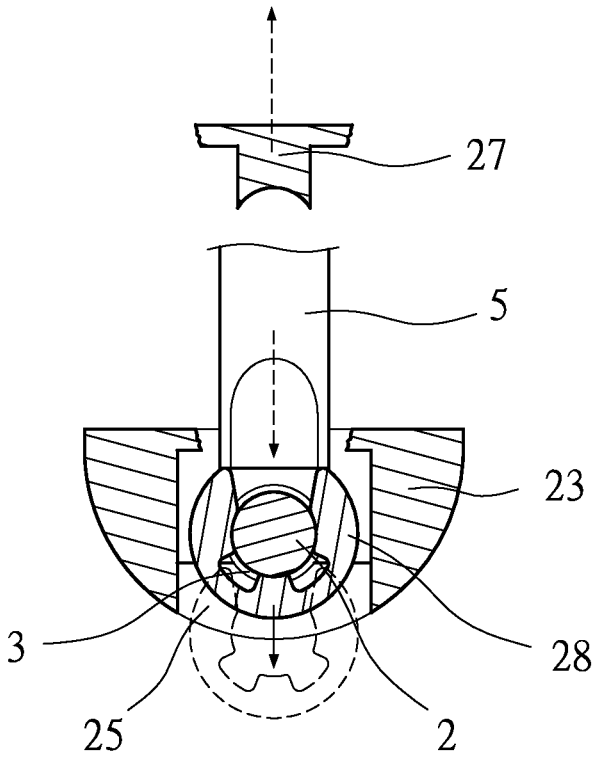
FIG. 7 is a schematic view according to the first embodiment of the present invention, showing the side positioning piece is cut off and the C-shaped buckle is pushed out of the positioning trough.
Figure 8:
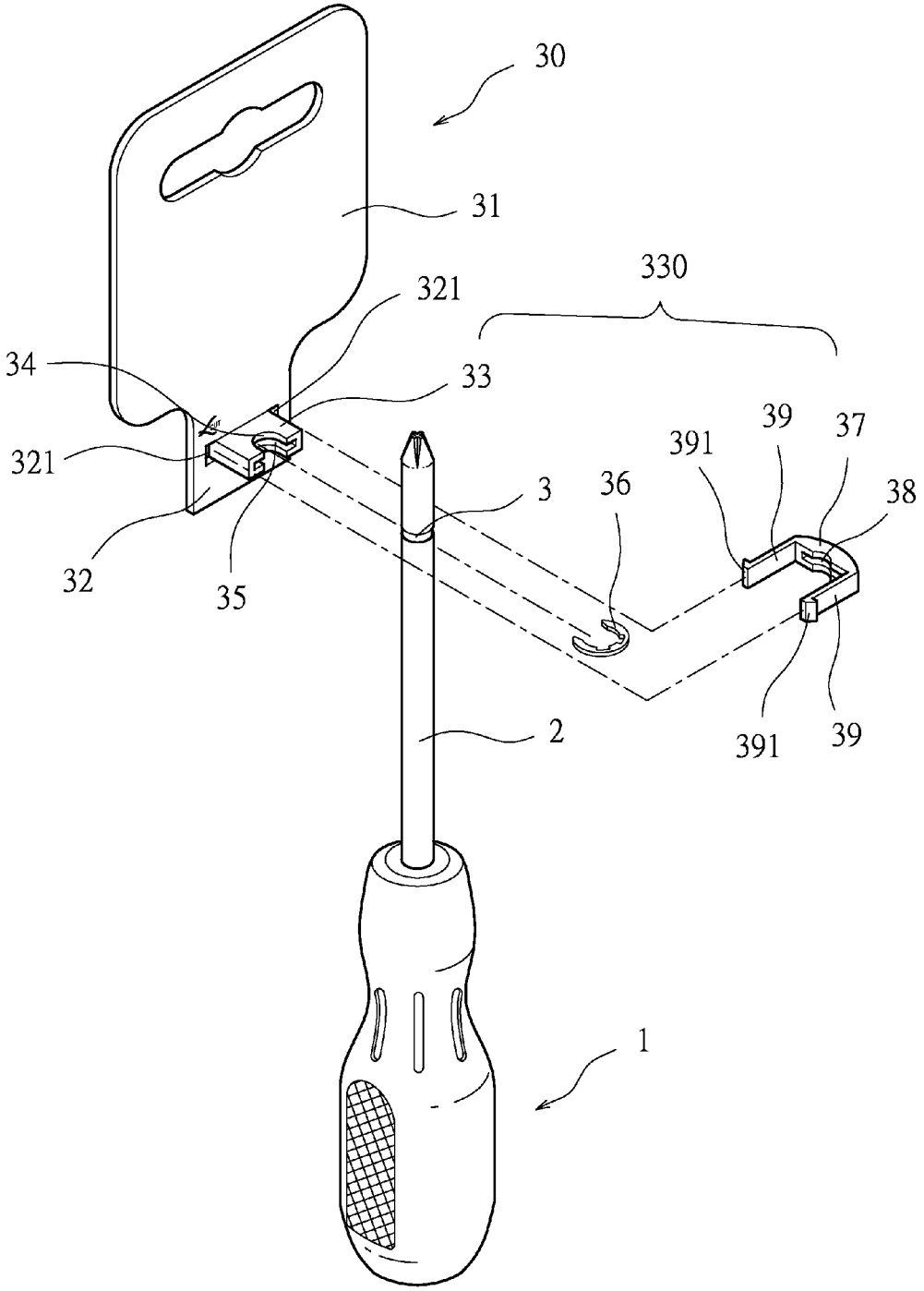
FIG. 8 is an exploded view according to a second embodiment of the present invention.

Referring to FIG. 4, FIG. 6 and FIG. 7, when the user wants to disengage the hand tool 1 from the display tag 20, a pair of scissors 4 is used to cut the two sides of the side positioning piece 27 at the side through hole 26 from the back of the display tag 20 so as to open the side through hole 26 bigger. A flat tool 5 is inserted into the side through hole 26 to push the C-shaped buckle 28 out of the positioning trough 25, such that the hand tool 1 can be taken out smoothly.

As shown in FIG. 8 through FIG. 12, an anti-theft structure of a hand tool display tag according to a second embodiment of the present invention comprises a hand tool 1 and a display tag 30. The display tag 30 comprises a main body 31 in a rectangular shape and an extension portion 32 disposed at a lower end of the main body 31. The extension portion 32 has a width less than that of the main body 31. A positioning protrusion seat 330 is horizontally provided on the extension portion 32. The positioning protrusion seat 330 comprises a positioning seat 33 and a separate positioning cover 37. An end face of the positioning seat 33 is formed with an arc notch 34. The end face of the positioning seat 33 is further formed with a horizontal rear positioning trough 35 penetrating the inside of the positioning seat 33. The extension portion 32 is formed with engaging holes 321 disposed at two sides of the positioning seat 33 respectively. The positioning cover 37 corresponds to the end face of the positioning seat 33 and is formed with a horizontal front positioning trough 38 penetrating the inside of the positioning cover 37. Two sides of the positioning cover 37 are provided with engaging portions 39, respectively. A distal end of each engaging portion 39 is provided with a one-way tooth 391. A C-shaped buckle 36 is embedded into the annular groove 3 of the rod body 2 of the hand tool 1 to buckle the rod body 2 in the arc trough 34. One side of the C-shaped buckle 36 is embedded in the rear positioning trough 35. The engaging portions 39 of the positioning cover 37 are inserted into the engaging holes 321, respectively. Another side of the C-shaped buckle 36 is embedded in the front positioning trough 38. A through hole is defined between the arc trough 34 of the positioning seat 33 and the positioning cover 37 for accommodating the rod body 2 of the hand tool 1. Through the aforesaid structure, the rod body 2 of the hand tool 1 is buckled by the C-shaped buckle 28 to be one-piece. The C-shaped buckle 28 is covered and hidden by the positioning protrusion seat 330, such that the hand tool 1 is unable to disengage from the display tag 30 to provide an anti-theft function.

The assembly of the second embodiment of the present invention is described hereinafter. The C-shaped buckle 36 is a thin buckle ring made of a metallic or plastic material, so that it has the capability of elastic deformation to be embedded into the annular groove 3 of the rod body 2 of the hand tool 1 unless an external force is applied to the C-shaped buckle 28 to disengage it from the annular groove 3. When the annular groove 3 of the rod body 2 of the hand tool 1 is buckled by C-shaped buckle 36, the C-shaped buckle 28 is embedded in the rear positioning trough 35, and then the engaging portions 39 of the positioning cover 37 are aligned with the engaging holes 321 of the extension portion 32 with the one-way teeth 391 of the engaging portions 29 to engage with the engaging holes 321. One side of the one-way tooth 391 is an inclined plane, and another side of the one-way tooth 391 is a flat plane. The width of each engaging hole 321 is less than the width of the one-way tooth 391. The inclined plane of the one-way tooth 391 is forced into the corresponding engaging hole 321. The one-way tooth 391 is slightly deformed to pass the corresponding engaging holes 321, and the flat plane of the one-way tooth 391 is engaged with the corresponding engaging hole 321. The front positioning trough 38 is configured to receive the C-shaped buckle 36. The front and rear positioning troughs 38, 35 are slots corresponding in shape and size to the C-shaped buckle 36 for the C-shaped buckle 36 to be covered and hidden by the positioning seat 33 and the positioning cover 37. Thus, it is unable to take out the C-shaped buckle 36 from the exterior of the positioning protrusion seat 330. The one-way tooth 391 won't disengage from the engaging hole 321, so the positioning cover 37 cannot be opened. This provides an anti-theft effect.

Figure 9:
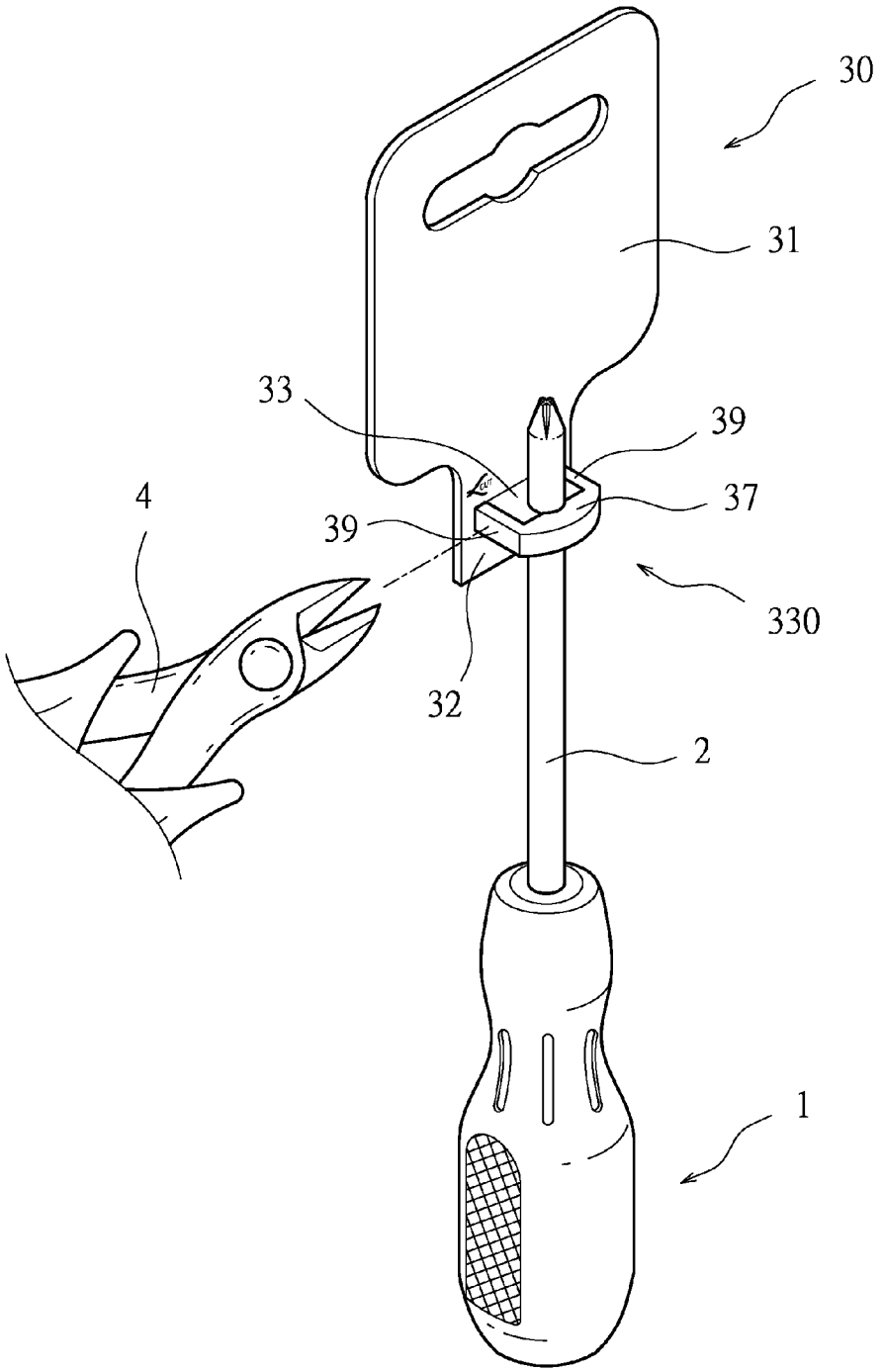
FIG. 9 is a perspective view according to the second embodiment of the present invention.
Figure 10:
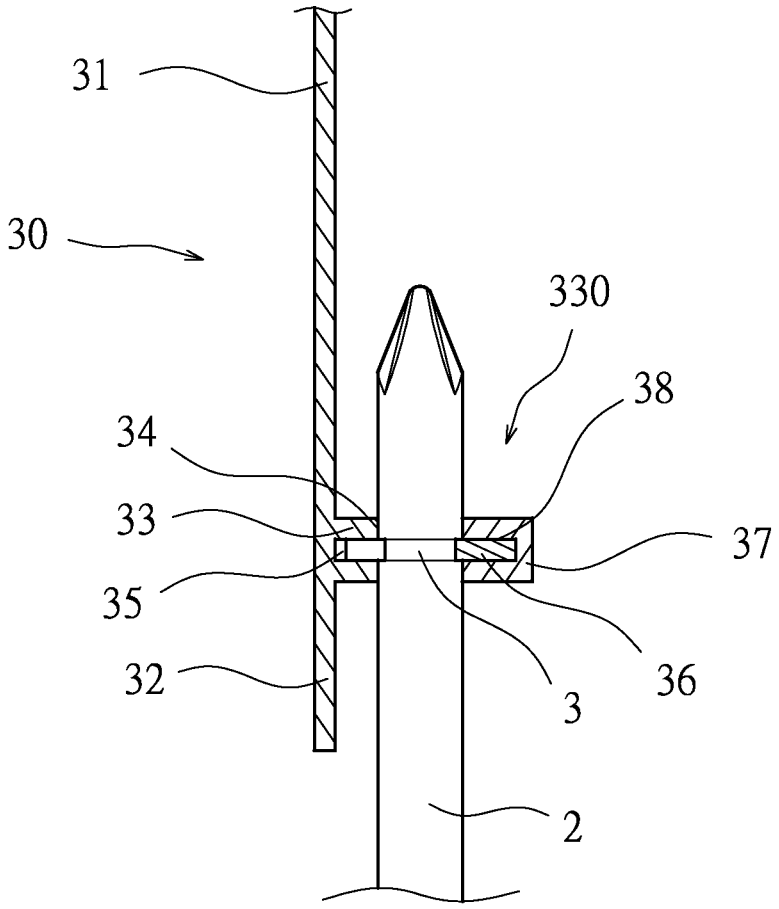
FIG. 10 is a side sectional view according to the second embodiment of the present invention.
Figure 11:
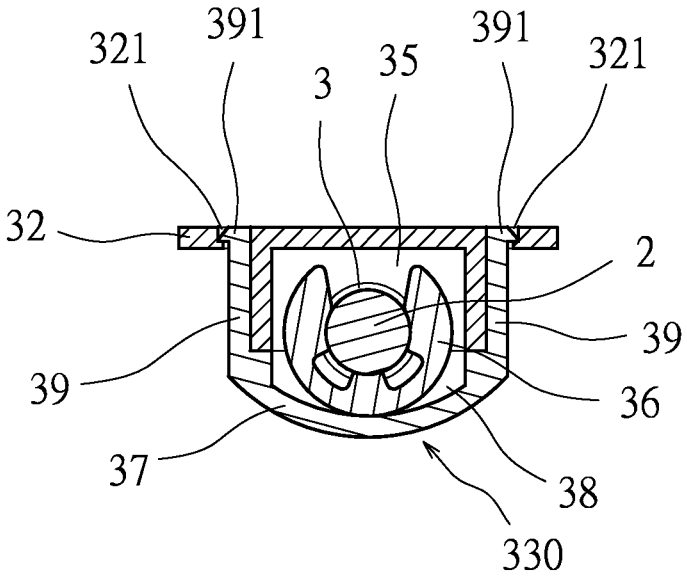
FIG. 11 is a top sectional view according to the second embodiment of the present invention.
Figure 12:
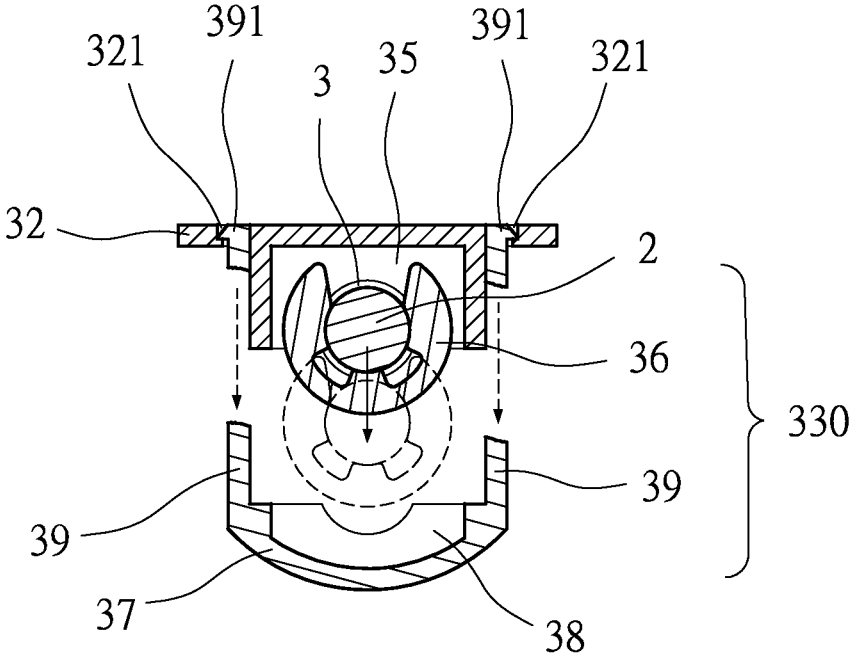
FIG. 12 is a schematic view according to the second embodiment of the present invention, showing the engaging portions are cut off to take the C-shaped buckle out.

Referring to FIG. 9, FIG. 11 and FIG. 12, when the user wants to disengage the hand tool 1 from the display tag 30, a pair of scissors 4 is used to cut off the engaging portions 39 of the positioning cover 37 so as to take out the positioning cover 37, and the C-shaped buckle 36 is exposed. Afterward the hand tool 1 and the C-shaped buckle 36 are departed from the rear positioning trough 35, such that the hand tool 1 can be taken out smoothly.

Figure 13:
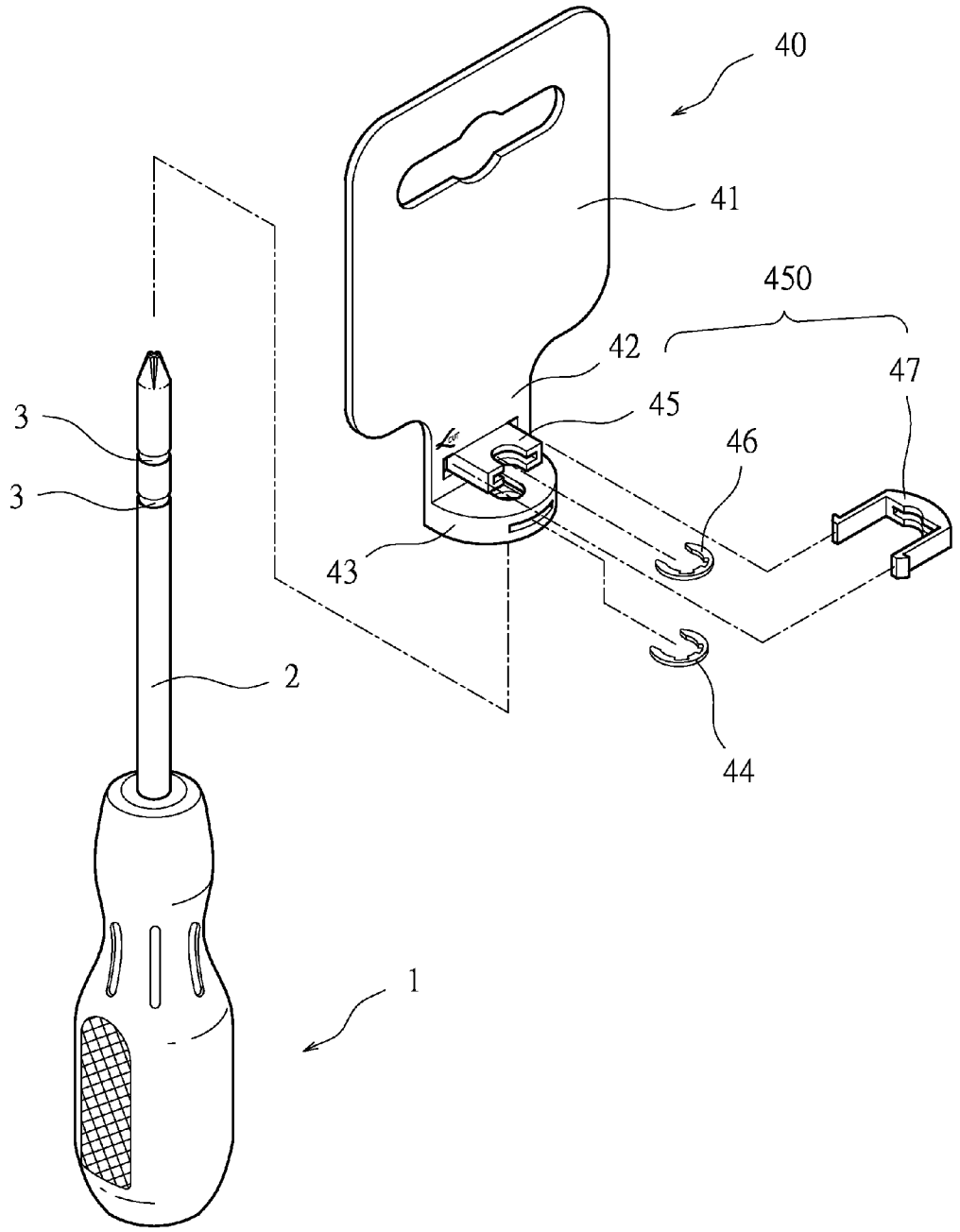
FIG. 13 is an exploded view according to a third embodiment of the present invention.
Figure 14:
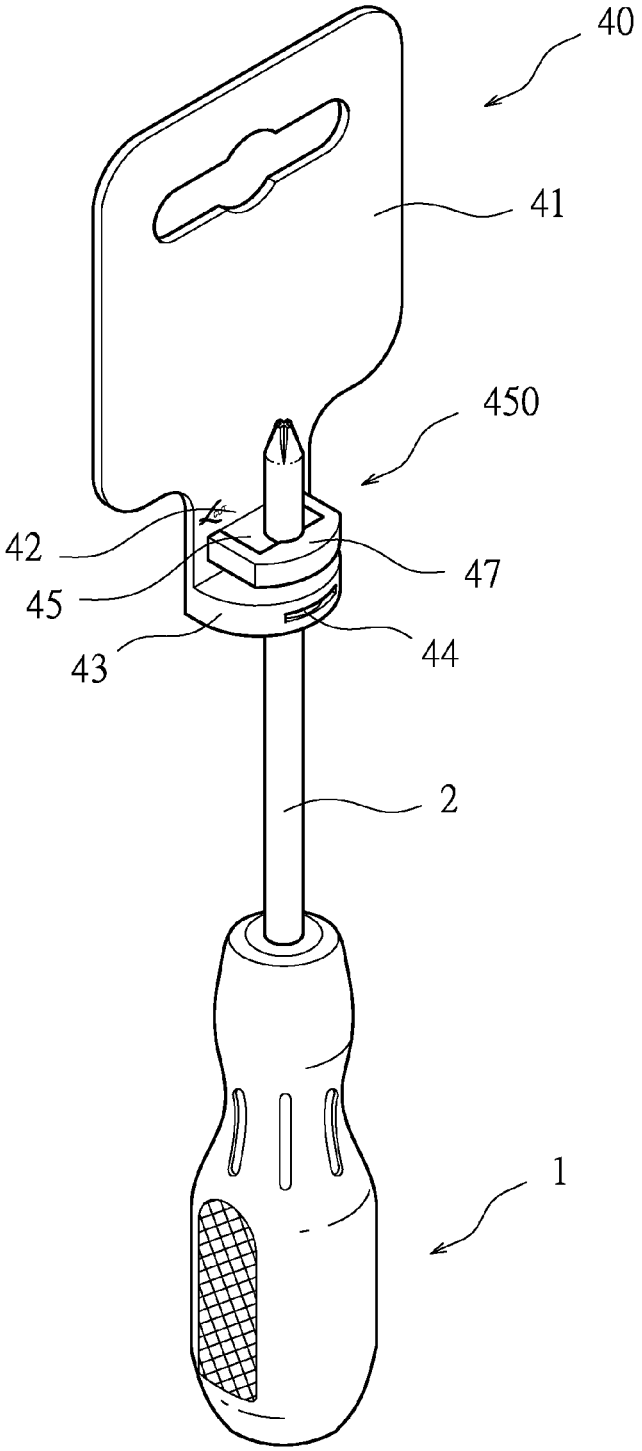
FIG. 14 is a perspective view according to the third embodiment of the present invention.
Figure 15:
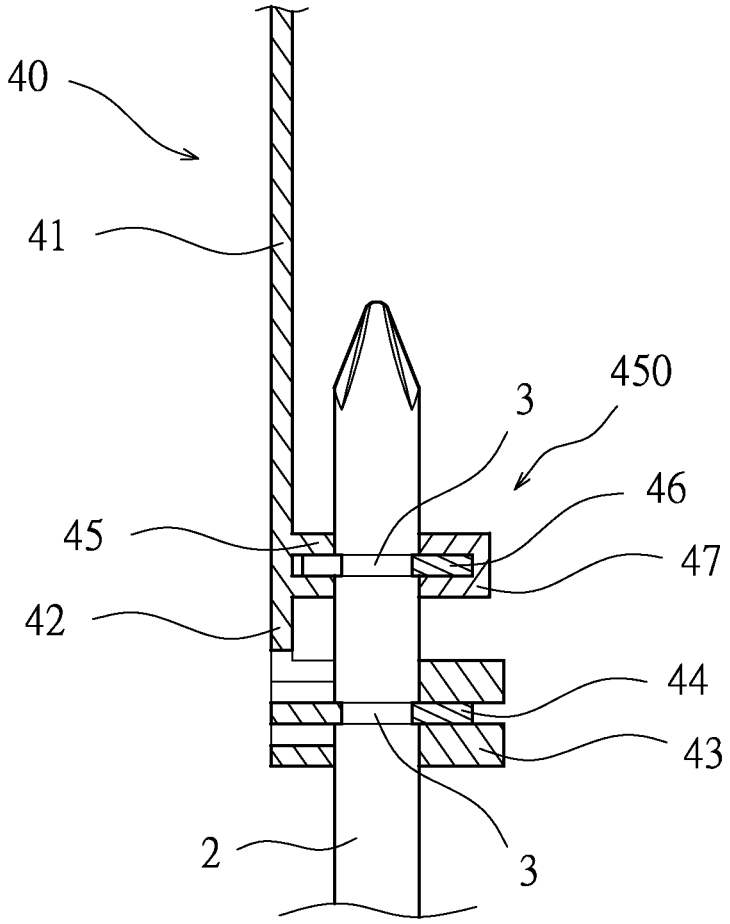
FIG. 15 is a side sectional view according to the third embodiment of the present invention.

As shown in FIG. 13 through FIG. 15, an anti-theft structure of a hand tool display tag according to a third embodiment of the present invention comprises a hand tool 1 and a display tag 40. The hand tool 1 comprises a rod body 2 having two annular grooves 3. The display tag 40 comprises a main body 41 and an extension portion 42 disposed at a lower end of the main body 41. A lower positioning protrusion seat 43 and an upper positioning protrusion seat 450 are horizontally provided on the extension portion 42. The upper positioning protrusion seat 450 comprises a positioning seat 45 and a separate positioning cover 47. The lower positioning protrusion seat 43 and the upper positioning protrusion seat 450 are provided with C-shaped buckles 44, 46 to engage with the annular grooves 3 of the rod body 2 of the hand tool 1, respectively. The positioning cover 47 is coupled to the positioning seat 35 to cover and hid the C-shaped buckle 46. The structure of the lower positioning protrusion seat 43 is equivalent to the positioning protrusion seat 23 as shown in FIG. 2 to FIG. 7. The structure of the upper positioning protrusion seat 450 is equivalent to the positioning protrusion seat 330 as shown in FIG. 8 to FIG. 12. The detailed structure, function and effect are described as the aforesaid. By the aforesaid structure, the hand tool 1 is unable to disengage from the display tag 40 to provide a dual anti-theft function.

Figure 16:
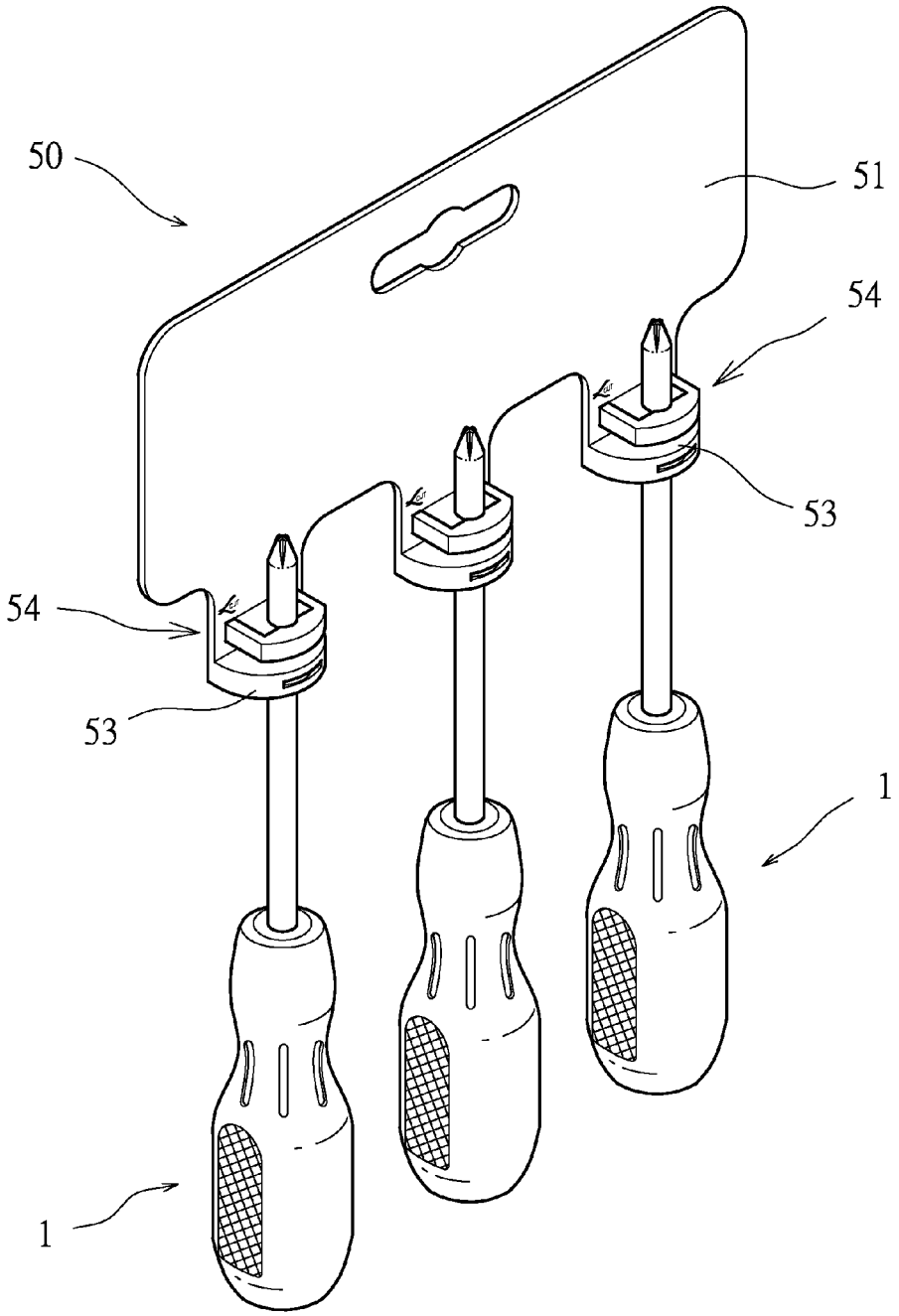
FIG. 16 is a schematic view according to another embodiment of the display tag of the present invention.

FIG. 16 shows another embodiment of a display tag 50 of the present invention. The display tag 50 comprises a main body 51 and at least two extension portions 52 disposed at a lower end of the main body 51. A lower positioning protrusion seat 53 and an upper positioning protrusion seat 54 are horizontally provided on each extension portion 52. When in use, a plurality of hand tools 1 can be displayed. This also provides an anti-theft effect.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An anti-theft structure of a hand tool display tag, comprising a hand tool and a display tag, the hand tool comprising a rod body having an annular groove, the display tag comprising:

a main body in a rectangular shape;

an extension portion disposed at a lower end of the main body, the extension portion having a width less than that of the main body;

a positioning protrusion seat protruding from the extension portion, the positioning protrusion seat having a vertical through hole, a front end face of the positioning protrusion seat being formed with a horizontal positioning trough penetrating an inside of the positioning protrusion seat, a rear end of the positioning protrusion seat being formed with a side through hole penetrating the inside of the positioning protrusion seat and communicating with the positioning trough, the side through hole being transversely provided with a side positioning piece; and a C-shaped buckle, cooperating with the rod body of the hand tool to pass through the through hole, being inserted into the positioning trough and engaged with the annular groove of the rod body of the hand tool, enabling the C-shaped buckle to be positioned between the positioning trough and the side positioning piece;

thereby, the rod body of the hand tool being buckled by the C-shaped buckle to be one-piece, the C-shaped buckle being covered and hidden by the positioning protrusion seat.

2. The anti-theft structure of a hand tool display tag as claimed in claim 1, wherein the positioning trough and the side positioning piece are disposed at a same plane.

3. The anti-theft structure of a hand tool display tag as claimed in claim 1, wherein the C-shaped buckle is made of a metallic material or a plastic material.

4. An anti-theft structure of a hand tool display tag, comprising a hand tool and a display tag, the hand tool comprising a rod body having an annular groove, the display tag comprising:

a main body in a rectangular shape;

an extension portion disposed at a lower end of the main body, the extension portion having a width less than that of the main body;

a positioning protrusion seat protruding from the extension portion, the positioning protrusion seat comprising a positioning seat and a separate positioning cover, an end face of the positioning seat being formed with an arc notch, the end face of the positioning seat being further formed with a horizontal rear positioning trough penetrating an inside of the positioning seat, the extension portion being formed with engaging holes disposed at two sides of the positioning seat respectively, the positioning cover corresponding to the end face of the positioning seat and being formed with a horizontal front positioning trough penetrating an inside of the positioning cover, two sides of the positioning cover being provided with engaging portions respectively; and a C-shaped buckle embedded into the annular groove of the rod body of the hand tool to buckle the rod body in the arc trough, one side of the C-shaped buckle being embedded in the rear positioning trough, the engaging portions of the positioning cover being inserted into the engaging holes respectively, another side of the C-shaped buckle being embedded in the front positioning trough, a through hole being defined between the arc trough of the positioning seat and the positioning cover for accommodating the rod body of the hand tool;

thereby, the rod body of the hand tool being buckled by the C-shaped buckle to be one-piece, the C-shaped buckle being covered and hidden by the positioning protrusion seat.

5. The anti-theft structure of a hand tool display tag as claimed in claim 4, wherein a distal end of each engaging portion is provided with a one-way tooth, one side of the one-way tooth is an inclined plane, and another side of the one-way tooth is a flat plane.

6. The anti-theft structure of a hand tool display tag as claimed in claim 4, wherein the C-shaped buckle is made of a metallic material or a plastic material.

* * * * *